US010497497B2

(12) United States Patent
Saguchi et al.

(10) Patent No.: US 10,497,497 B2
(45) Date of Patent: Dec. 3, 2019

(54) R-T-B—GA-BASED MAGNET MATERIAL ALLOY AND METHOD OF PRODUCING THE SAME

(71) Applicant: SANTOKU CORPORATION, Hyogo (JP)

(72) Inventors: Akihiko Saguchi, Hannan (JP); Noriyuki Negi, Tokyo (JP); Mitsuharu Yonemura, Tokyo (JP)

(73) Assignee: SANTOKU CORPORATION, Hyogo (JP)

( * ) Notice: Subject to any disclaimer, the term of this patent is extended or adjusted under 35 U.S.C. 154(b) by 0 days.

(21) Appl. No.: 15/869,380

(22) Filed: Jan. 12, 2018

(65) Prior Publication Data

US 2019/0013122 A1 Jan. 10, 2019

Related U.S. Application Data

(63) Continuation-in-part of application No. 14/375,199, filed as application No. PCT/JP2013/000568 on Feb. 1, 2013, now abandoned.

(30) Foreign Application Priority Data

Feb. 2, 2012 (JP) ..... 2012-020518

(51) Int. Cl.
*H01F 1/057* (2006.01)
*C22C 30/00* (2006.01)
(Continued)

(52) U.S. Cl.
CPC ..... *H01F 1/057* (2013.01); *B22F 3/24* (2013.01); *B22F 9/04* (2013.01); *C22C 1/04* (2013.01);
(Continued)

(58) Field of Classification Search
CPC ..... H01F 1/0571; H01F 1/057; C22C 1/04; C22C 2202/02; C22C 30/00; B22F 9/04;
(Continued)

(56) References Cited

U.S. PATENT DOCUMENTS

2005/0268989 A1 12/2005 Tomizawa
2008/0261159 A1 10/2008 Odaka

FOREIGN PATENT DOCUMENTS

CN 1254828 5/2006
CN 102199719 9/2011
(Continued)

*Primary Examiner* — Colleen P Dunn
*Assistant Examiner* — Anthony M Liang
(74) *Attorney, Agent, or Firm* — Clark & Brody

(57) ABSTRACT

Disclosed is an R-T-B—Ga-based magnet material ahoy where R is at least one element selected from rare earth metals including Y and excluding Gd, Tb, Dy, Ho, Er, Tm, Yb, and Lu, and T is one or more transition metals with Fe being an essential element. The R-T-B—Ga-based magnet material alloy includes: an $R_2T_{14}B$ phase 3 which is a principal phase, and an R-rich phase (1 and 2) which is a phase enriched with the R, wherein a non-crystalline phase 1 in the R-rich phase has a Ga content (mass %) that is higher than a Ga content (mass %) of a crystalline phase 2 in the R-rich phase. With this, it is possible to enhance the magnetic properties of rare earth magnets that are manufactured from the alloy and reduce variations in the magnetic properties thereof.

4 Claims, 3 Drawing Sheets

(51) Int. Cl.

| | |
|---|---|
| ***C22C 1/04*** | (2006.01) |
| ***B22F 9/04*** | (2006.01) |
| *B22F 3/24* | (2006.01) |

(52) U.S. Cl.
CPC ..... *C22C 30/00* (2013.01); *B22F 2003/248* (2013.01); *B22F 2009/044* (2013.01); *B22F 2301/45* (2013.01); *B22F 2998/10* (2013.01); *B22F 2999/00* (2013.01); *C22C 2202/02* (2013.01)

(58) Field of Classification Search
CPC .. B22F 3/24; B22F 2301/45; B22F 2003/248; B22F 2009/044
See application file for complete search history.

(56) References Cited

FOREIGN PATENT DOCUMENTS

| | | |
|---|---|---|
| JP | 06-45168 | 2/1994 |
| JP | 2751109 | 5/1998 |
| JP | 3171415 | 5/2001 |
| JP | 3298220 | 7/2002 |
| JP | 3298221 | 7/2002 |
| JP | 2005-150503 | 6/2005 |
| JP | 2008-214747 | 9/2008 |
| JP | 4508065 | 7/2010 |
| JP | 2012-79726 | 4/2012 |
| WO | 2005/105343 | 11/2005 |
| WO | 2010/113465 | 10/2010 |
| WO | 2013/008756 | 1/2013 |

R-T-B—GA-BASED MAGNET MATERIAL ALLOY AND METHOD OF PRODUCING THE SAME

This application is a Continuation-in-Part of U.S. Ser. No. 14/375,199 filed on Jul. 29, 2014, which is a national phase of PCT/JP2013/000568 filed on Feb. 1, 2013.

TECHNICAL FIELD

The present invention relates to an alloy for use as a rare earth magnet material and a method of producing the same. More particularly, the present invention relates to an R-T-B—Ga-based magnet material alloy and a method of producing the same capable of enhancing the magnetic properties of rare earth magnets that are manufactured from the alloy and reducing variations in the magnetic properties thereof.

BACKGROUND ART

R-T-B-based alloys, which exhibit good magnetic properties, are available for use as a rare earth magnet alloy. For production of R-T-B-based alloys, strip casting methods are widely used.

The production of R-T-B-based alloys by a strip casting method may be carried out by the following procedure, for example.

(a) A molten R-T-B-based alloy is prepared by loading raw materials into a crucible and heating and melting them;

(b) The molten alloy is supplied, via a tundish, to the outer peripheral surface of a chill roll having a structure in which coolant circulates, and quenched. Thus, the molten alloy is solidified to be cast into a ribbon;

(c) The cast ribbon is crushed into alloy flakes; and (d) The produced alloy flakes are cooled.

The above operations (a) to (d) are usually carried out under reduced pressure or in an inert gas atmosphere to prevent oxidation of the R-T-B-based alloy.

R-T-B-based alloys produced by such a procedure have an alloy crystal structure in which a principal phase and an R-rich phase coexist. The principal phase is a crystalline phase of an $R_2T_{14}B$ phase, and the R-rich phase is enriched with the rare earth metal. The principal phase is a ferromagnetic phase that contributes to magnetization, and the R-rich phase is a non-magnetic phase that does not contribute to magnetization.

R-T-B-based alloys can be used as a material for sintered magnets and bonded magnets. In particular R-T-B-based sintered magnets, which have a high energy product ((BH) max) and a high coercive force (Hcj), are used in a variety of applications.

R-T-B-based sintered magnets may be produced by the following process, for example.

(1) Alloy flakes of an R-T-B-based alloy are hydrogen decrepitated (coarsely pulverized), and then are finely ground in a jet mill or the like to form a fine powder;

(2) The produced fine powder is pressed in a magnetic field into a green body; and (3) The pressed green body is sintered in a vacuum and then the sintered body is heat treated (tempered), whereby R-T-B-based sintered magnets can be manufactured.

In recent years, there has been an increasing need for R-T-B-based sintered magnets, which are manufactured in this manner, to have a higher coercive force. To address this need, efforts are being made to improve the magnetic properties by adding Ga to an R-T-B-based alloy in an amount of about 0.05% to 0.2% by mass. By using a Ga-containing R-T-B-based alloy as a material to manufacture sintered magnets, it is possible to improve the coercive force of the sintered magnets without decreasing their energy product.

With regard to the addition of Ga to an R-T-B-based alloy for sintered magnets, there are various conventional proposals as disclosed in Patent Literatures 1 to 8, for example. Patent Literature 1 relates to an R—Fe—Co—B—Ga-M-based sintered magnet and specifies the amount of Ga to be added. Patent Literature 1 discloses that the addition of Ga improves the coercive force, stating that the reason for this is that the Curie temperature is increased in the BCC phase, which is a soft magnetic phase present at the grain boundaries of an Fe—Co—B—Ga-M-based sintered magnet, so that a significant pinning effect is produced.

Patent Literature 2 relates to an R—Fe—Co—Al—Nb—Ga—B-based sintered magnet, Patent Literature 3 relates to an R—Fe—Nb—Ga—Al—B-based sintered magnet, and Patent Literature 4 relates to an R—Fe—V—Ga—Al—B-based sintered magnet. Patent Literatures 2 to 4 disclose that the balance of the magnetic properties is supplemented by including Dy, a heavy rare earth element, as a technique for improving the coercive force without compromising the energy product.

However, in the actual manufacturing of Ga-containing R-T-B-based sintered magnets, variations in magnetic properties are observed in manufactured sintered magnets, and this poses a problem. Possible causes of the variations in magnetic properties of Ga-containing R-T-B-based sintered magnets are the variations that occur during the process of manufacturing sintered magnets such as for example: variations in elemental diffusion in sintering and heat treatment; or variations in the ground fine powder among the lots. However, there have been a number of uncertainties as to the influence of Ga over the alloy microstructure of a Ga-containing R-T-B-based sintered magnet, and there remains a need to reduce the variations in magnetic properties.

Patent Literature 5 relates to an R-T-B-based sintered magnet and discloses that: the residual flux density and coercive force of a sintered magnet are increased by including a region having a concentrated heavy rare earth element RH at the interface between the principal phase and the R-rich phase of the sintered magnet. Patent Literature 5 discloses Ga as an element that may be added to the R-T-B-based alloy.

Patent Literature 6 relates to an R-T-B-based sintered magnet, and discloses a sintered magnet that includes, on its surface, an amorphous phase-containing layer containing a rare earth metal and oxygen disposed to cover an R-rich phase and thereby exhibits sufficient corrosion resistance even at elevated temperatures. Patent Literature 6 discloses Ga as an element that may be added to the R-T-B-based alloy.

Patent Literature 7 relates to an R-T-B-based magnet material alloy and discloses that: by using an R-T-B-based alloy including a Dy-rich region near its R-rich phase, sintered magnets having a higher coercive force can be manufactured. Patent Literature 7 discloses a Ga-containing R-T-B-based alloy.

However, Patent Literatures 5 to 7 disclose nothing about the advantageous effect of the addition of Ga and its influence over the alloy crystal structure in an R-T-B-based alloy that serves as a magnet material.

Patent Literature 8 discloses casting of an R-T-Q-based magnet material alloy (Q is at least one element selected from the group consisting of B, C, N, Al, Si and P) in which:

a molten alloy is quenched to a temperature between 700° C. and 900° C. to be solidified and then is thermally maintained at 700° C. to 900° C. for 15 to 600 seconds, and thereafter is cooled to 400° C. or less. It is stated that this allows heavy rare earth elements such as Dy to be diffused to the principal phase from the grain boundaries, thereby providing the advantage of an increased coercive force achieved by the heavy rare earth elements such as Dy without the need to heat treat the solidified alloy that has cooled to around room temperature. Patent Literature 8 discloses Ga as an element that may be added to the R-T-Q-based alloy. However, Patent Literature 8 discloses nothing about the influence of the microstructure with Ga on the coercive force in the alloy crystal structure.

CITATION LIST

Patent Literature

Patent Literature 1: Japanese Patent No. 2751109
Patent Literature 2: Japanese Patent No. 3171415
Patent Literature 3: Japanese Patent No. 3298220
Patent Literature 4: Japanese Patent No. 3298221
Patent Literature 5: International Publication No. WO2010/113465
Patent Literature 6: Japanese Patent Application Publication No. 2008-214747
Patent Literature 7: Japanese Patent No. 4508065
Patent Literature 8: International Publication No. WO2005/105343

SUMMARY OF INVENTION

Technical Problem

As described above, efforts are being made to increase the coercive force of R-T-B-based sintered magnets by adding Ga to an R-T-B-based magnet material alloy. However, in the manufacturing of Ga-containing R-T-B-based sintered magnets, variations in magnetic properties are observed among manufactured sintered magnets, and this poses a problem. Also, it is desired that the magnetic properties of sintered magnets be further enhanced.

The present invention has been made in view of this situation. Accordingly, it is an object of the present invention to provide an R-T-B—Ga-based magnet material alloy and a method of producing the same capable of enhancing the magnetic properties of rare earth magnets that are manufactured from the alloy and reducing variations in the magnetic properties thereof.

Solution to Problem

In the casting of R-T-B-based alloys using a strip casting method as described above, a molten alloy solidifies on a chill roll. During the process, an $R_2Fe_{14}B$ phase, which is a principal phase, crystallizes first, and then the rare earth metal having a lower melting point is released to the grain boundaries and concentrated there to form an R-rich phase.

In order to optimize the magnetic properties, particularly the coercive force and the energy product, of a rare earth magnet made from such an R-T-B-based alloy containing a principal phase and an R-rich phase, it is preferred that impurities be released from the principal phase into the R-rich phase in the process of crystallization of the principal phase. However, when the alloy is in the as-solidified state on the chill roll, it is often the case that the impurities partially form a supersaturated solid solution within the principal phase.

The present inventors investigated R-T-B-based magnet alloys and intensively studied methods for facilitating the release of impurities within the principal phase into the R-rich phase, and consequently they have made the following findings.

The R-T-B-based alloy should be formed with a composition including Ga. In addition, the alloy flakes produced by crushing a ribbon cast by solidification on a chill roll should be subjected to a treatment in which: they are thermally maintained by being held at a temperature in the range of 650° C. to the melting temperature of the alloy for a predetermined time and then cooled at a cooling rate of 1° C. to 9° C. per second. This enables formation of an R-T-B—Ga-based alloy having a crystal structure in which: an R-rich phase formed along the grain boundaries of the principal phase 3 includes both a non-crystalline phase (an amorphous phase) 1 and a crystalline phase 2 therein, as shown in the later-described Example by referring to FIG. 1. Furthermore, in the crystal structure of the resulting R-T-B—Ga-based alloy, the non-crystalline phase 1 in the R-rich phase has a higher Ga content than that of the crystalline phase 2 in the R-rich phase. It is believed that the crystal structure having this configuration is formed in the following manner.

When a molten Ga-containing R-T-B—Ga-based alloy is solidified on a chill roll, an $R_2Fe_{14}B$ phase, which is the principal phase, crystallizes first as is the case with a Ga-free R-T-B-based alloy. Then, in the Ga-containing R-T-B—Ga-based alloy, the principal phase, a B-rich phase ($RFe_4B_4$), and a liquid phase coexist, and the rare earth metal having a lower melting point is released into the liquid phase and concentrated to form an R-rich phase. The principal phase, the B-rich phase and the R-rich phase, which is a liquid phase, form an equilibrium at the ternary eutectic point. Performing the thermal maintenance at 650° C. or higher in such a condition where sufficient liquid phase is present promotes diffusion between the principal phase and the R-rich phase, which allows release (cleansing) of the impurities within the principal phase into the R-rich phase to be concentrated therein. Examples of the impurity elements include Ga, which is intentionally added, as well as those introduced due to a variety of factors in the production process, including raw materials, e.g., Si, Mn, O (oxygen) and others, when the alloy is industrially produced.

Ga and the rare earth metal released into the R-rich phase form a low melting point eutectic alloy by containing trace amounts of impurities. It is believed that, in a Ga-containing low melting point eutectic alloy, composition fluctuations occur in part of the melt as the cooling rate increases so that a non-crystalline phase having a temperature equal to or lower than the glass transition temperature (Tg) is likely to form.

The present inventors have discovered that an R-T-B-based alloy provides the following advantages (1) and (2) when it contains Ga and has an R-rich phase in which a non-crystalline phase and a crystalline phase coexist and further the non-crystalline phase has a higher Ga content.

(1) In the above-described R-T-B-based alloy, Ga, which is non-oxidizing and highly mobile, produces a driving force when it is diffused and moved into the grain boundaries during the formation of the principal phase, and by the driving force, impurities within the principal phase are drawn and released into the R-rich phase together with the move of the Ga, and thus the principal phase is cleared.

When sintered magnets are manufactured from such R-T-B-based alloy, the saturation magnetization of the principal phase is increased and therefore the energy product of the manufactured sintered magnets is increased.

(2) In the above-described R-T-B-based alloy, the grain boundary phase includes a Ga-containing lower melting point non-crystalline phase. Because of this, when sintered magnets are manufactured from the R-T-B-based alloy, the lower melting point R-rich phase is easily movable during sintering, so that the interfacial mismatch between the principal phase and the R-rich phase is reduced. Therefore reverse magnetic domain nucleation is reduced, which results in improving and stabilizing the coercive force of the resulting sintered magnets.

The present invention has been accomplished based on the above findings, and the summaries thereof are set forth below in the items (1) and (2) relating to an R-T-B—Ga-based magnet material alloy and the item (3) relating to a method of producing the R-T-B—Ga-based magnet material alloy.

(1) An R-T-B—Ga-based magnet material alloy (where R is at least one element selected from rare earth metals including Y and excluding Gd, Tb, Dy, Ho, Er, Tm, Yb, and Lu, and T is one or more transition metals with Fe being an essential element), the R-T-B—Ga-based magnet material alloy comprising:

an $R_2T_{14}B$ phase which is a principal phase; and an R-rich phase which is a phase enriched with the R, the R-rich phase including a non-crystalline phase and a crystalline phase, the non-crystalline phase having a Ga content (mass %) that is higher than a Ga content (mass %) of the crystalline phase.

(2) The R-T-B—Ga-based magnet material alloy according to the above item (1), wherein the magnet material alloy has an average thickness in a range of 0.1 mm to 1.0 mm.

(3) A method of producing the R-T-B—Ga-based magnet material alloy according to the above item (1) or (2), the method comprising:

a first step of casting a ribbon from a molten R-T-B—Ga-based alloy using a strip casting method and crushing the ribbon to produce alloy flakes; and a second step of thermally maintaining the alloy flakes by holding the alloy flakes at a predetermined temperature for a predetermined time and then cooling the alloy flakes;

the first step and the second step being performed under reduced pressure or in an inert gas atmosphere;

the second step being performed such that the alloy flakes are thermally maintained at a temperature in a range of 650° C. to the melting temperature of the alloy, and after the thermal maintenance, the alloy flakes are cooled at a cooling rate of 1° C. to 9° C. per second to at least 400° C.

Advantageous Effects of Invention

The magnet material alloy of the present invention has an R-rich phase that includes a non-crystalline phase having a higher Ga-content. Because of this, when the magnet material alloy of the present invention is used as a material for sintered magnets, it is possible to reduce the reverse magnetic domain nucleation in resulting sintered magnets and thus provide improvement and stabilization of the coercive force thereof. Furthermore, it is possible to improve the saturation magnetization and increase the residual flux density of the resulting sintered magnet.

The method of producing a magnet material alloy of the present invention includes thermally maintaining alloy flakes and thereafter cooling the alloy flakes, wherein the temperature for the thermal maintenance is in the range of 650° C. to the melting temperature of the alloy, and the cooling rate is 1° C. to 9° C. per second. This enables the production of a magnet material alloy having a higher Ga-content non-crystalline phase in its R-rich phase.

BRIEF DESCRIPTION OF DRAWINGS

FIG. 2(*a*) shows the result of analysis of the non-crystalline phase in the R-rich phase; FIG. 2(*b*) shows the result of analysis of the crystalline phase in the R-rich phase; and FIG. 2(*c*) shows the result of analysis of the principal phase.

DESCRIPTION OF EMBODIMENTS

Figure 1:
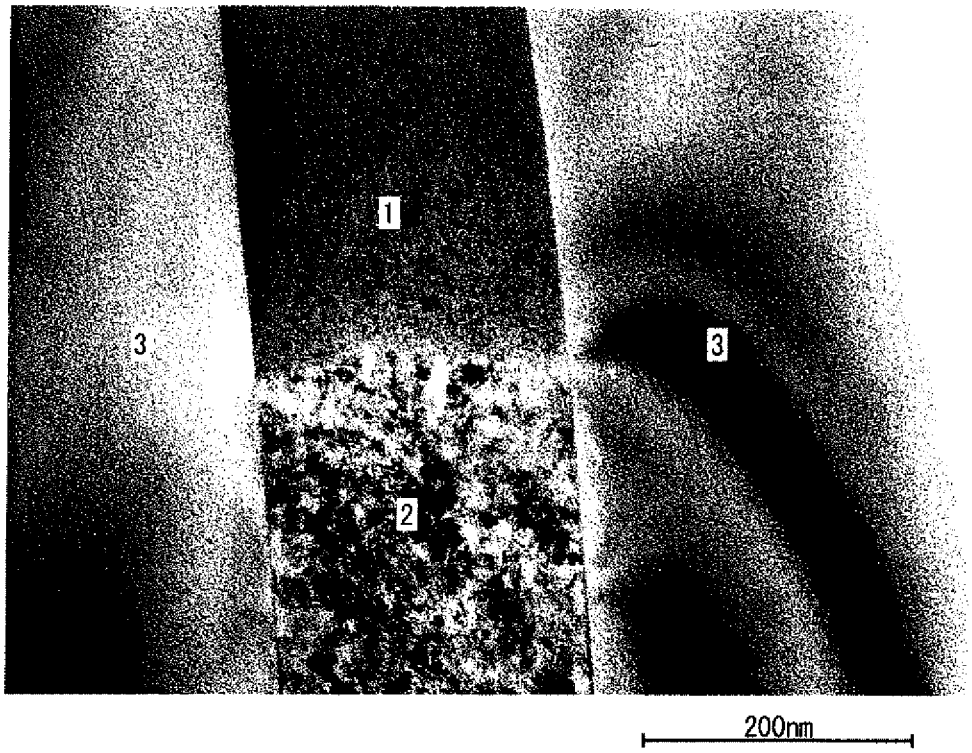
FIG. 1 is an image taken with a transmission electron microscope of the crystal structure of a specimen prepared from the alloy flakes of Inventive Example 1-A.

1. Magnet Material Alloy of the Present Invention

As described above, the magnet material alloy of the present invention is an R-T-B—Ga-based magnet material alloy where R is at least one element selected from rare earth metals including Y, and T is one or more transition metals with Fe being an essential element, the R-T-B—Ga-based magnet material alloy comprising: an $R_2T_{14}B$ phase which is a principal phase and an R-rich phase which is a phase enriched with the R, wherein the R-rich phase includes a non-crystalline phase and a crystalline phase, and the non-crystalline phase has a Ga content that is higher than a Ga content of the crystalline phase. The following provides an explanation of the reasons for specifying the magnet material alloy of the present invention as set forth above and preferred embodiments thereof.

[Alloy Composition]

The magnet material alloy of the present invention is an R-T-B—Ga-based alloy having a composition that includes, as the R, at least one element selected from rare earth metals including Y; as the T, one or more transition metals with Fe being an essential element; B (boron); and Ga (gallium).

As the R, Nd, Pr, Dy, and Tb are particularly preferred among the rare earth metals including Y, but other rare earth metals such as Sm, La, Ce, Gd, Ho, Er, and Yb may be included. Another embodiment of the invention is one wherein R intentionally does not include or excludes the addition of one or more heavy rare earth elements, that is, Gd, Tb, Dy, Ho, Er, Tm, Yb, and Lu. Of course, the R-T-B—Ga based alloy of the invention in any embodiment would include inevitably-contained impurities.

T is one or more transition metals with Fe being an essential element, and Fe alone may constitute the T. The Fe may be partially replaced by Co because Co, among transition metals, produces the effect of enhancing heat resistance. Co acts to reduce the coercive force Hcj in a rare earth-based alloy magnet, but it produces the effect of improving the temperature coefficient of the residual flux density Br. Thus, inclusion of Co increases the squareness of the demagnetization curve, which results in an improved energy product BH (max). Co is preferably included in an amount of 50% or less based on the total T content in order to achieve a balance in magnetic properties for industrial use as a permanent magnet.

The R content preferably ranges from 27.0% by mass to 35.0% by mass. If the R content is less than 27.0% by mass, the amount of rare earth metals necessary for good sintering is not met in the sintering of a green body made from the alloy used as a material for sintered magnets. This results in a decrease in the coercive force. On the other hand, if it exceeds 35.0% by mass, the principal phase becomes relatively small so that the residual flux density Br is decreased. A more preferred R content is from 28.5% by mass to 33.0% by mass although it depends on the desired balance in magnetic properties.

The B content preferably ranges from 0.90% by mass to 1.20% by mass. If it is less than 0.90% by mass, sufficient coercive force Hcj and residual flux density Br may not be achieved in a rare earth magnet made from the alloy. If it exceeds 1.20% by mass, a sufficient residual flux density Br may not be achieved in a rare earth magnet made from the alloy.

[Ga in Non-Crystalline Phase in R-Rich Phase]

The magnet material alloy of the present invention includes an $R_2T_{14}B$ phase 3 which is a principal phase and an R-rich phase (1 and 2) which is a phase enriched with the R, and the R-rich phase has a non-crystalline phase 1 and a crystalline phase 2 as shown in the later-described Example by referring to FIG. 1. The non-crystalline phase 1 in the R-rich phase has a higher Ga content than that of the crystalline phase 2 in the R-rich phase. A detailed description is provided below regarding the advantage of enhanced magnetic properties of sintered magnets to be manufactured from such alloy of the present invention which is used as a material for sintered magnets.

The coercivity mechanism of R-T-B-based sintered magnets is classified as a nucleation type based on the reverse magnetic domain nucleation, and typically the coercive force $H_{cj}$ can be expressed by the following equation (1).

$$H_{cj}=C\times H_A-N\times I_s \quad (1)$$

where C is a coefficient representing a decrease in the magnetic anisotropy due to defects near the grain boundaries, surface conditions or the like; $H_A$ is an anisotropy field; N is a demagnetizing factor depending on the size and shape of the grains; and $I_s$ is a saturation magnetization of the principal phase.

As can be seen from the above equation (1), in order to increase the coercive force of an R-T-B-based sintered magnet, it is important to enhance the magnetocrystalline anisotropy $H_A$ of the principal phase as well as to optimize the coefficients C and N, i.e., the balance between the shape, dispersion and the like in the sinter structure.

It is noted that the magnetocrystalline anisotropy $H_A$ of the principal phase is mostly determined by the magnet component system. Thus, optimization of the factors C and N is industrially important. Specifically, increasing the coefficient C and decreasing the coefficient N, i.e., enhancing the interface matching between the principal phase and the R-rich grain boundary phase as well as forming a finer sinter structure leads to an increase in coercive force in an R-T-B-based sintered magnet.

It is known that decreasing the coefficient N, i.e., formation of a finer sinter structure can be achieved to some extent in the sintered magnet manufacturing process. Specifically, the formation of a finer sinter structure can be achieved by making the particle size of the fine powder smaller when the fine powder is prepared by grinding a material alloy, or by lowering the sintering temperature when a green body is sintered.

In the meantime, increasing the coefficient C, i.e., enhancement of the interface matching between the principal phase and the R-rich phase, is greatly affected by the melting point of the R-rich phase. Lowering the melting point of the R-rich phase enhances the interface matching between the principal phase and the R-rich phase. If the melting point of the R-rich phase is lowered, it becomes a melt at an earlier stage of the heating process and the melt viscosity relatively decreases in a conventional temperature range for thermal maintenance (e.g. about 1050° C.) when a green body is sintered in the sintered magnet manufacturing process. Because of this, the wettability between the R-rich phase and the principal phase is improved, which results in enhancing the interface matching.

The magnet material alloy of the present invention has a higher Ga-content non-crystalline phase in its R-rich phase. This is intended to enhance the interface matching between the principal phase and the R-rich phase by lowering the melting point of the R-rich phase. Such non-crystalline phase in the R-rich phase is formed, for example, by thermally maintaining alloy flakes, obtained by crushing a ribbon, under predetermined conditions and then cooling them at a cooling rate of 1° C. to 9° C. per second.

When the slow cooling rate of 1° C. to 9° C. per second is used, a crystalline phase is formed in the R-rich phase while an amorphous phase is formed as nuclei therein because of the presence of Ga in the R-rich phase. The Ga content in the crystalline phase of the R-rich phase is lower than the Ga content in the non-crystalline phase of the R-rich phase. That is, as a greater number of non-crystalline phases, which have a higher Ga content than the crystalline phase, are formed in the R-rich phase, lower melting non-crystalline phases increase. This results in improving the wettability between the R-rich phase and the principal phase to enhance the interface matching when a green body is sintered in the sintered magnet manufacturing process. However, in alloy systems including a heavy rare earth element such as, for example, Dy, Tb, or Ho, if the cooling rate is greater than 9° C. per second, the heavy rare earth element would not sufficiently diffuse to the principal phase in the resulting magnet material alloy. Thus, sintered magnets made from the alloy would tend to exhibit a lower coercive force.

In the meantime, it is known that the residual flux density Br of an R-T-B-based sintered magnet is enhanced as the saturation magnetization $I_s$ of the principal phase increases. Since the saturation magnetization of the principal phase is proportional to the volume of the $R_2T_{14}B$ phase, which is a ferromagnetic phase, it is necessary to increase the crystallinity, i.e., purity, of the $R_2T_{14}B$ phase.

The magnet material alloy of the present invention has an R-rich phase that includes a non-crystalline phase having a higher Ga-content. That is, Ga and other impurities are released into the R-rich phase from the principal phase. This is intended to enhance the residual flux density Br of a sintered magnet by increasing the purity of the principal phase in the material alloy. The release of impurities from the principal phase into the R-rich phase is promoted by thermally maintaining the hot alloy flakes, obtained by crushing a ribbon, at a temperature in the range of 650° C. to the melting temperature of the alloy, which activates the elemental diffusion between the R-rich phase and the principal phase. Examples of the impurities that are released from the principal phase into the R-rich phase include Si, Mn and O (oxygen). In particular, it is believed that the melt of Ga, which is non-oxidizing and highly mobile, facilitates the diffusion of the impurities.

As described, the magnet material alloy of the present invention includes a non-crystalline phase and a crystalline phase in its R-rich phase, and the non-crystalline phase in the R-rich phase has a higher Ga content than that of the crystalline phase in the R-rich phase. The higher Ga content non-crystalline phase in the R-rich phase has a lower melting point. This results in improving the wettability between the R-rich phase and the principal phase to enhance the interface matching when a green body is sintered in the process of manufacturing sintered magnets from the alloy of the present invention. Consequently, reverse magnetic domain nucleation is reduced in the resulting sintered magnets and thus the coercive force thereof is enhanced.

Furthermore, when the wettability between the R-rich phase and the principal phase is improved when a green body is sintered in the process of manufacturing sintered magnets from the alloy of the present invention, a homogeneous non-magnetic phase is formed around the principal phase. Because of this, reverse magnetic domain nucleation is reduced and the variations in the coercive force are reduced to provide stabilization in the resulting sintered magnet.

Furthermore, since the magnet material alloy of the present invention is formed to have a higher Ga-content non-crystalline phase in its R-rich phase, the impurity elements within the principal phase are released into the R-rich phase together with Ga, so that the principal phase is cleared and its purity is increased. As such, sintered magnets made from the alloy of the present invention have improved saturation magnetization and an increased residual flux density Br.

The magnet material alloy of the present invention preferably has an average thickness of 0.1 mm to 1.0 mm. It is noted that the average thickness of the magnet material alloy varies in accordance with the thickness of the ribbon that is cast. The average thickness of a magnet material alloy varies from the thickness of a ribbon in accordance with the volume percentage of the R-rich phase, which is a final solidification phase, but the amount of variation is very small. Thus, the average thickness of a magnet material alloy nearly equals the thickness of a ribbon.

If a magnet material alloy having an average thickness smaller than 0.1 mm is to be obtained, the thickness of the ribbon should be smaller than 0.1 mm, too. This would cause excessively rapid cooling of the surface of the ribbon (molten alloy) that contacts with the chill roll and therefore would lead to an increased likelihood of formation of chill grains, which adversely affect the magnetic properties, in the alloy crystal structure. On the other hand, if a magnet material alloy having an average thickness greater than 1.0 mm is to be obtained, the thickness of the ribbon should be greater than 1.0 mm, too. This would lead to a reduced degree of cooling of the ribbon (molten alloy) by the chill roll, which may result in less likelihood of formation of homogeneous columnar dendrites in the alloy crystal structure. In addition, in certain alloy compositions, there may be a problem such as crystallization of an α-Fe phase by the peritectic reaction in the alloy crystal structure.

2. Method of Producing Magnet Material Alloy of the Present Invention

The method of producing a magnet material alloy of the present invention includes producing a magnet material alloy of the present invention as described above, the method comprising: a first step of casting a ribbon from a molten R-T-B—Ga-based alloy using a strip casting method and crushing the ribbon to produce alloy flakes; and a second step of thermally maintaining the alloy flakes by holding the alloy flakes at a predetermined temperature for a predetermined time and then cooling the alloy flakes; the first step and the second step being performed under reduced pressure or in an inert gas atmosphere, wherein, in the second step, the alloy flakes are thermally maintained at a temperature in a range of 650° C. to the melting temperature of the alloy, and after the thermal maintenance, the alloy flakes are cooled at a cooling rate of 1° C. to 9° C. per second to at least 400° C. The following provides an explanation of the reasons for specifying the method of producing a magnet material alloy of the present invention as set forth above and preferred embodiments thereof.

[First Step]

In the first step, a ribbon is cast from a molten R-T-B—Ga-based alloy using a strip casting method. Any type of strip casting method may be employed for the ribbon casting as long as it is capable of forming homogeneous columnar dendrites in the crystal structure of the ribbon that is cast by quenching on the contact surface of the chill roll. Thus, either of the following methods may be employed: a single roll method in which a molten alloy is supplied to the outer peripheral surface of a single chill roll; and a twin roll method in which a molten alloy is supplied to a gap formed between two rolls.

When a ribbon is cast using a strip casting method, the ribbon is preferably cast with a thickness of 0.1 to 1.0 mm. When the thickness of the ribbon is smaller than 0.1 mm, the surface of the ribbon (molten alloy) that contacts with the chill roll would be cooled too rapidly. This would lead to an increased likelihood of formation of chill grains, which adversely affect the magnetic properties, in the crystal structure of the cast ribbon. On the other hand, when the thickness of the ribbon is greater than 1.0 mm, the degree of cooling of the ribbon (molten alloy) by the chill roll would be reduced. Thus, problems such as the following occur: a reduced possibility of formation of homogeneous columnar dendrites; or crystallization of an α-Fe phase by the peritectic reaction in certain alloy structures.

Alloy flakes are produced by crushing such a ribbon that is cast by a strip casting method.

[Second Step]

In the second step, the alloy flakes produced in the first step as described above are thermally maintained by being held in the hot condition at a predetermined temperature for a predetermined time without being cooled, and thereafter are cooled. During this process, in the method of producing a magnet material alloy of the present invention, the temperature for the thermal maintenance is set to a temperature in the range of 650° C. to the melting temperature of the alloy, and the cooling after the thermal maintenance is performed at a cooling rate of 1° C. to 9° C. per second to at least 400° C.

If the temperature for the thermal maintenance is lower than 650° C., the melting point (eutectic point) of the rare earth-Ga-based intermetallic compound is not reached, and therefore the R-rich phase may not melt to form a liquid phase. On the other hand, if the temperature for the thermal maintenance exceeds the melting temperature of the alloy, part of the alloy melts to adhere to the processing machine. The upper limit of the temperature for the thermal maintenance is preferably 900° C. or less in consideration of, for example, a change in the alloy content due to the formation of the liquid phase.

The hold time for the thermal maintenance is preferably 60 to 1200 seconds although it depends on how much spacing is required between R-rich phases in the magnet material alloy. If the hold time is shorter than 60 seconds, sufficient heating of the liquid phase does not take place, which results in poor elemental diffusion. On the other hand, if the hold time is longer than 1200 seconds, the liquid phase may flow out of the alloy flakes, and this could cause a change in content in the resulting magnet material alloy.

For the cooling after the thermal maintenance, the cooling is performed at a cooling rate of 1° C. to 9° C. per second to at least 400° C. The cooling rate v (° C./second) in the method of producing a magnet material alloy of the present invention may be calculated, for example, by the following equation (2).

$$v=(T1-T2)/\Delta t \quad (2)$$

where Δt is the time (second) that has elapsed after the start of the cooling; T1 is the temperature (° C.) of the alloy flakes at the start of the cooling; and T2 is the temperature (° C.) of the alloy flakes after the time Δt has elapsed.

In the method of producing a magnet material alloy of the present invention, "cooled to at least 400° C." means: the cooling is performed such that the alloy flakes have a temperature of 400° C. or less at the completion of the cooling, i.e., it is essential that the cooling rate be regulated in the temperature range between the temperature for the thermal maintenance and 400° C. Cooling in a strip casting method often involves slight compositional segregation on the surface of the alloy flakes and inside thereof due to unavoidable inhomogeneity of the surface of the chill roll during the solidification operation or introduction of microoxides or the like during the melting or pouring operation. In the production method of the present invention, the cooling rate is regulated to be in the range of 1° C. to 9° C. per second in the temperature range between the temperature for the thermal maintenance and a sufficiently lower temperature (400° C.) than the liquid phase temperature (about 650° C.). This enables the formation of the higher Ga content non-crystalline phase in the R-rich phase even if there is a slight segregation and presence of a liquid phase having a lower melting point than that of a normal liquid phase.

If the cooling rate for the cooling after the thermal maintenance is slower than 1° C. per second, a sufficient rate of solidification of the R-rich phase melt is not achieved, and therefore it is impossible to form the higher Ga content non-crystalline phase. On the other hand, if the cooling rate is faster than 9° C. per second, Ga, which has an atomic weight smaller, by as much as about 50%, than that of the rare earth metal, a principal component of the R-rich phase, cannot sufficiently diffuse within the R-rich phase, and therefore is impeded from selectively moving to the non-crystalline phase. As a result, the percentage of the lower melting point phase in the non-crystalline phase is decreased. Thus, the wettability between the R-rich phase and the principal phase is not improved when a green body is sintered in the process of manufacturing sintered magnets from the produced alloy, and this results in a decreased coercive force in the manufactured sintered magnets. In addition, in alloy systems including a heavy rare earth element such as, for example, Dy, Tb, or Ho, when the cooling rate is greater than 9° C. per second, sufficient diffusion of the heavy rare earth element to the principal phase does not occur. Because of this, the coercive force is further decreased.

The method of producing a magnet material alloy of the present invention as described includes thermally maintaining alloy flakes, obtained by crushing a ribbon, at 650° C. or higher. This activates the elemental diffusion between the R-rich phase and the principal phase, and therefore promotes the release of impurities including Ga from the principal phase to the R-rich phase. As a result, it is possible to clear the principal phase and increase its purity. In addition, the method of producing a magnet material alloy of the present invention includes cooling the alloy flakes at a cooling rate of 1° C. to 9° C. per second after the thermal maintenance. This allows formation of a crystal structure in which an R-rich phase includes a non-crystalline phase and a crystalline phase and the non-crystalline phase in the R-rich phase has a higher Ga content than that of the crystalline phase in the R-rich phase. As a result, the resulting magnet material alloy has a crystal structure in which its R-rich phase includes a non-crystalline phase and a crystalline phase and the non-crystalline phase in the R-rich phase has a higher Ga content than that of the crystalline phase in the R-rich phase.

EXAMPLES

To verify the advantages of the magnet material alloy of the present invention and the method of producing the same, R-T-B—Ga-based alloys were prepared and their crystal structures were examined. Also, sintered magnets were made from the prepared R-T-B—Ga-based alloys, and their magnetic properties were investigated.

1. Test Method

[Magnet Material Alloy]

In this test, R-T-B—Ga-based alloy flakes were prepared in accordance with the procedures of Inventive Examples 1 and 2, Conventional Example, and Comparative Examples 1 to 3 as described below. In any of the procedures, the composition of the R-T-B—Ga-based alloy flakes was as follows: by mass percent, Nd: 24.0%; Pr: 5.0%; Dy: 2.0%; B: 1.0%; and Ga: 0.10% with the balance being Fe and impurities. R-T-B—Ga-based alloy flakes of this composition have a melting point of about 650° C.

In Inventive Example 1-A, in a chamber under an atmosphere of 300 Torr of argon, 300 kg mass of raw materials were loaded into an alumina crucible and then were melted by radio frequency induction heating to yield a molten alloy. The molten alloy was cast into a ribbon by a strip casting method using a single roll in the chamber. In this process, the molten alloy was supplied to the outer peripheral surface of the chill roll via an alumina tundish. The amount of the molten alloy to be supplied and the number of revolutions of the chill roll were adjusted so that the ribbon was formed to have a thickness of 0.3 mm and thus the resulting alloy flakes had an average thickness of 0.3 mm. The cast ribbon was crushed by a crusher disposed downstream of the chill roll in the chamber to produce alloy flakes.

Subsequently, the produced alloy flakes were loaded into a rotary drum vessel disposed downstream of the crusher in the chamber. In this process, the temperature of the alloy flakes was 762° C. as measured with a two-color pyrometer. The rotary drum vessel used for thermal maintenance and cooling includes a thermal maintenance zone at the upstream side where a heater is disposed and a cooling zone using water cooling at the downstream side. It is thus capable of applying a thermal maintenance treatment and a cooling treatment in sequence to the loaded alloy flakes.

The temperature for the thermal maintenance was adjusted to be 660±10° C. and the time for the alloy flakes to pass through the thermal maintenance zone (time for the thermal maintenance) was adjusted to be 613 seconds. This was accomplished by setting the number of revolutions of the rotary drum vessel to 1 rpm and adjusting the output of the heater of the thermal maintenance zone. Thereafter, the alloy flakes were cooled in the cooling zone. In this process, the temperature of the alloy flakes as measured 100 seconds after they entered the cooling zone was 160° C. The cooling rate v for cooling to 160° C. was calculated by the above-described equation (2) using the temperature for the thermal maintenance (660° C.) as the temperature T1 of the alloy flakes at the start of the cooling, and the cooling rate v was found to be 5.0° C. per second.

Subsequently, the alloy flakes discharged from the cooling zone were taken out from the chamber. They were placed in a metallic vessel filled with argon gas, and was allowed to cool in the metallic vessel to room temperature.

In Inventive Example 1, in addition to Inventive Example 1-A as described above in which the alloy flakes had an average thickness of 0.3 mm, Inventive Examples 1-B to 1-D, in each of which the alloy flakes had a different average thickness, were provided. In Inventive Examples 1-B to 1-D, the thickness of the ribbon was varied so that the average thickness of the alloy flakes was varied by adjusting the amount of the molten alloy to be supplied and the number of revolutions of the chill roll. In Inventive Example 1-B, the ribbon was formed to have a thickness of 0.11 mm so that the alloy flakes had an average thickness of 0.11 mm; in Inventive Example 1-C, the ribbon was formed to have a thickness of 0.50 mm so that the alloy flakes had an average thickness of 0.50 mm; and in Inventive Example 1-D, the ribbon was formed to have a thickness of 0.90 mm so that the alloy flakes had an average thickness of 0.90 mm. It is noted that, in Inventive Examples 1-B to 1-D, the cooling rate v was changed with the changes in the thickness of the ribbon and the average thickness of the alloy flakes.

In Inventive Example 2-A, a ribbon was cast by a strip casting method under the same conditions as in Inventive Example 1, and then it was crushed into alloy flakes. In Inventive Example 2, for the thermal maintenance and subsequent cooling performed by loading the crushed alloy flakes into the rotary drum vessel, the temperature for the thermal maintenance was adjusted to be 880±10° C. by adjusting the output of the heater of the thermal maintenance zone. The temperature of the alloy flakes when they were to be loaded into the rotary drum vessel was 771° C., and the time for the thermal maintenance was 630 seconds.

Thereafter, when the alloy flakes were cooled in the cooling zone, the temperature of the alloy flakes 100 seconds after they entered the cooling zone was 400° C. The cooling rate v for cooling to 400° C. was calculated by the above-described equation (2) using the temperature for the thermal maintenance (880° C.) as the temperature T1 of the alloy flakes at the start of the cooling, and the cooling rate v was found to be 4.8° C. per second.

In Inventive Example 2, in addition to Inventive Example 2-A as described above in which the alloy flakes had an average thickness of 0.3 mm, Inventive Examples 2-B to 2-D, in each of which the alloy flakes had a different average thickness, were provided. In Inventive Examples 2-B to 2-D, the thickness of the ribbon was varied so that the average thickness of the alloy flakes was varied by adjusting the amount of the molten alloy to be supplied and the number of revolutions of the chill roll. In Inventive Example 2-B, the ribbon was formed to have a thickness of 0.11 mm so that the alloy flakes had an average thickness of 0.11 mm; in Inventive Example 2-C, the ribbon was formed to have a thickness of 0.50 mm so that the alloy flakes had an average thickness of 0.50 mm; and in Inventive Example 2-D, the ribbon was formed to have a thickness of 0.90 mm so that the alloy flakes had an average thickness of 0.90 mm. It is noted that, in Inventive Examples 2-B to 2-D, the cooling rate v was changed with the changes in the thickness of the ribbon and the average thickness of the alloy flakes.

In Conventional Example, an ingot having a thickness of 30 mm and a height of 500 mm was cast from a molten alloy by a mold casting method, and the ingot was crushed to yield alloy flakes.

In Comparative Example 1, a ribbon was cast by a strip casting method under the same conditions as in Inventive Example 1, and then it was crushed into alloy flakes. In Comparative Example 1, for the thermal maintenance and subsequent cooling performed by loading the crushed alloy flakes into the rotary drum vessel, the temperature for the thermal maintenance was adjusted to be 630±10° C. by adjusting the output of the heater of the thermal maintenance zone. The temperature of the alloy flakes when they were to be loaded into the rotary drum vessel was 766° C., and the time for the thermal maintenance was 620 seconds.

Thereafter, when the alloy flakes were cooled in the cooling zone, the temperature of the alloy flakes 100 seconds after they entered the cooling zone was 100° C. The cooling rate v for cooling to 100° C. was calculated by the above-described equation (2) using the temperature for the thermal maintenance (630° C.) as the temperature T1 of the alloy flakes at the start of the cooling, and the cooling rate v was found to be 5.3° C. per second.

In Comparative Example 2, a ribbon was cast by a strip casting method under the same conditions as in Inventive Example 1, and then it was crushed into alloy flakes. In Comparative Example 2, for the thermal maintenance and subsequent cooling performed by loading the crushed alloy flakes into the rotary drum vessel, the temperature for the thermal maintenance was adjusted to be 1180±20° C. by adjusting the output of the heater of the thermal maintenance zone. The temperature of the alloy flakes when they were to be loaded into the rotary drum vessel was 758° C. In Comparative Example 2, a long time, i.e., 920 seconds was required for the alloy flakes to pass through the thermal maintenance zone. Thus, the thermal maintenance zone was inspected, and it was found that a large number of the loaded alloy flakes adhered to the inner surface of the thermal maintenance zone. Because of this, in Comparative Example 2, the test was discontinued with the result that no alloy flakes were produced.

In Comparative Example 3, a ribbon was cast by a strip casting method under the same conditions as in Inventive Example 1, and then it was crushed into alloy flakes. In Comparative Example 3, for the thermal maintenance and subsequent cooling performed by loading the crushed alloy flakes into the rotary drum vessel, the number of revolutions of the rotary drum vessel was varied. Accordingly, the time for the thermal maintenance was 620 seconds. The temperature of the alloy flakes when they were to be loaded into the rotary drum vessel was 766° C.

Thereafter, when the alloy flakes were cooled in the cooling zone, the temperature of the alloy flakes 100 seconds after they entered the cooling zone was 580° C. The cooling rate v for cooling to 580° C. was calculated by the above-described equation (2) using the temperature for the thermal maintenance (660° C.) as the temperature T1 of the alloy flakes at the start of the cooling, and the cooling rate v was found to be 0.8° C. per second.

In Comparative Examples 4 to 7, the average thickness of the alloy flakes was varied in the ribbon casting using a strip casting method. The varying of the average thickness of the alloy flakes was accomplished by changing the thickness of the ribbon by adjusting the amount of the molten alloy to be supplied and the number of revolutions of the chill roll. In Comparative Example 4, the ribbon was formed to have a thickness of 0.08 mm so that the alloy flakes had an average thickness of 0.08 mm; in Comparative Example 5, the ribbon was formed to have a thickness of 0.09 mm so that the alloy flakes had an average thickness of 0.09 mm; in Comparative Example 6, the ribbon was formed to have a thickness of 1.1 mm so that the alloy flakes had an average thickness of 1.1 mm; and in Comparative Example 7, the ribbon was formed to have a thickness of 1.2 mm so that the alloy flakes had an average thickness of 1.2 mm. The other conditions used than these were the same as those of Inventive Example 1, although, in Comparative Examples 4 to 7, the cooling rate v was changed with the changes in the thickness of the ribbon and the average thickness of the alloy flakes.

[Crystal Structure]

Regarding the alloy flakes produced in Inventive Examples 1-A and 2-A, Conventional Example, and Comparative Examples 1 and 3, their crystal structures were examined. In the examination of the crystal structure, for observation of the crystal structure using a transmission electron microscope (TEM), the alloy flakes were treated by ion milling at the surface that contacted with the chill roll and at the surface that was naturally cooled, and specimens were prepared from the thicknesswise central portion thereof. The grain boundaries of the specimens were observed using a transmission electron microscope equipped with a $LaB_6$ filament at an acceleration voltage of 300 kV.

Also, using energy dispersive X-ray spectroscopy (EDS), an accessory to the transmission electron microscope, the elemental distributions in the principal phase and the R-rich phase of the crystal structure of the alloy flakes were investigated. Furthermore, when it was found that the R-rich phase of the crystal structure includes both a crystalline phase and a non-crystalline phase, elemental distributions in the crystalline phase and the non-crystalline phase of the R-rich phase were also investigated.

From the investigated elemental distributions of the crystalline phase and the non-crystalline phase in the R-rich phase, the Ga contents of the crystalline phase and the non-crystalline phase were each calculated by calculating the mean value of the Ga contents of randomly selected three sites of each phase. Based on the sum of the Ga content of the crystalline phase (mass %) and the Ga content of the non-crystalline phase (mass %) that was calculated, the proportion of the Ga content of the crystalline phase (mass %) and the proportion of the Ga content of the non-crystalline phase (mass %) were each calculated and expressed in percent. These were determined to be the Ga content percentages (%) of the crystalline phase and the non-crystalline phase.

Regarding the alloy flakes produced in Inventive Examples 1 and 2, Conventional Example, and Comparative Examples 1 and 3 to 7, the area percentage of chill grains (%) and the area percentage of α-Fe were measured for each of them. In the measurements of the area percentage of chill grains and the area percentage of α-Fe, specimens obtained by the following procedure were used.

(1) The produced alloy flakes were taken, and they were mounted in a thermosetting resin and fixed.

(2) For observation of the thicknesswise cross section, the alloy flake fixed in the resin was roughly polished with 120 grit emery paper and then polished by 1200 grit emery paper followed by 3000 grit emery paper, and was mirror finished.

(3) The mirror finished cross section of the alloy flake was etched with nital for five seconds.

Using specimens obtained by the above procedure, the area percentage of chill grains was determined by the following procedure.

(1) Images of the etched cross sections of the alloy flakes were taken at a magnification of 85× using a polarizing microscope.

(2) The taken images were fed into an image processor, and the chill grains were extracted based on fine equiaxed crystal domain.

(3) The area of the chill grains and the cross sectional area of the alloy flake were each calculated, and the area of the chill grains was divided by the cross sectional area of the alloy flake. The result was expressed in percent and defined as the area percentage of chill grains (%).

Also, using specimens obtained by the above procedure, the area percentage of α-Fe was determined by the following procedure.

(1) Images of the etched cross sections of the alloy flakes were taken at a magnification of 150× using a scanning electron microscope.

(2) The taken images were fed into the image processor, and the α-Fe zone was extracted based on the relative chromaticity (black).

(3) The area of the α-Fe zone and the cross sectional area of the alloy flake were each calculated, and the area of the α-Fe zone was divided by the cross sectional area of the alloy flake. The result was expressed in percent and defined as the area percentage of α-Fe (%).

[Average Thickness of Alloy Flakes]

Regarding the alloy flakes produced in Inventive Examples 1 and 2, Conventional Example, and Comparative Examples 1 and 3 to 7, the average thickness was measured for each of them. In the measurement of the average thickness, ten samples were taken from the produced alloy flakes. Their thicknesses were measured at a central position of the surface of each sample that contacted with the chill roll using a spherical anvil and spindle type micrometer, and the mean value of the thicknesses of the ten samples was calculated.

[Sintered Magnet]

Using the alloy flakes produced in Inventive Examples 1 and 2, Conventional Example, and Comparative Examples 1 and 3 to 7 as a material, sintered magnets were fabricated by the following procedure. Firstly, the alloy flakes were subjected to hydrogen decrepitation (coarse pulverization) by hydrogenation crushing at a hydrogen pressure of 2 $kg/cin^2$ followed by dehydrogenation in a vacuum at 500° C. for one hour. The coarse powder was milled into a fine powder in a jet mill using a high purity nitrogen at a gas pressure of 6 $kg/cm^2$. The fine powder had an average particle size of 3.1 μm as determined by an air permeability method.

The produced fine powder was pressed at a pressure of 150 MPa in a vertical magnetic field of 2500 $kAm^{-1}$, thereby being formed into a green body. The green body was sintered at 1050° C. for three hours, and the sintered body was subjected to a heat treatment at 600° C. for one hour to be formed into a permanent magnet.

The heat treated sintered body was cut into pieces sized to 10 mm by 10 mm. Then, they were ground at their end surfaces using a surface grinder to be made into sintered magnets. To determine the residual flux density (Br), energy product ((BH) max) and coercive force (Hcj) of the produced sintered magnets, measurements were made using a B—H tracer.

Based on the measurement results, evaluations of the magnetic properties of the sintered magnets were made. In Table 1 below, reference symbols in the "evaluation" section have the following meanings.

○: The symbol ○ indicates good magnetic properties, i.e., a residual flux density Br of 18.0 kG or more, an energy product (BHmax) of 49.0 MGOe or more, and a coercive force (Hcj) of 14.0 kOe or more.

x: The symbol x indicates any of the following is true: a residual flux density Br of less than 18.0 kG, an energy product (BHmax) of less than 49.0 MGOe, and a coercive force (Hcj) of less than 14.0 kOe.

3. Test Results

Table 1 shows details of each test: the casting method used to produce the R-T-B—Ga-based alloy; the temperature for thermal maintenance and the cooling rate when alloy flakes are thermally maintained and thereafter cooled; Ga content percentages of the non-crystalline phase and crystalline phase in the R-rich phase of the alloy flakes; and the residual flux density, energy product, coercive force and result of evaluation of magnetic properties of the produced sintered magnet. Table 1 also shows the average thickness of the alloy flakes, the area percentage of chill grains, and the area percentage of α-Fe.

[Table 1]

TABLE 1

| Classification | Casting Method | Temperature For Thermal Maintenance (° C.) | Cooling Rate (° C./sec) | Ga Content Percentage In R-Rich Phase: Non-Crystalline phase (%) | Ga Content Percentage In R-Rich Phase: Crystalline Phase (%) |
|---|---|---|---|---|---|
| Inventive Ex. 1-A | Strip Casting | 660 | 5.00 | 88 | 12 |
| Inventive Ex. 1-B | | | 5.12 | 87 | 13 |
| Inventive Ex. 1-C | | | 4.84 | 90 | 10 |
| Inventive Ex. 1-D | | | 4.79 | 89 | 11 |
| Inventive Ex. 2-A | Strip Casting | 880 | 4.80 | 89 | 11 |
| Inventive Ex. 2-B | | | 4.92 | 89 | 11 |
| Inventive Ex. 2-C | | | 4.49 | 93 | 7 |
| Inventive Ex. 2-D | | | 4.35 | 92 | 8 |
| Conventional Ex. | Mold Casting | — | — | (Not Detected) | 100 |
| Comparative Ex. 1 | Strip Casting | 630 | 5.3 | 41 | 59 |
| Comparative Ex. 2 | Strip Casting | 1180 | — | — | — |
| Comparative Ex. 3 | Strip Casting | 660 | 0.8 | (Not Detected) | 100 |
| Comparative Ex. 4 | Strip Casting | 660 | 5.5 | (Not Examined) | (Not examined) |
| Comparative Ex. 5 | Strip Casting | 660 | 5.5 | (Not Examined) | (Not examined) |
| Comparative Ex. 6 | Strip Casting | 660 | 3.4 | (Not Examined) | (Not examined) |
| Comparative Ex. 7 | Strip Casting | 660 | 3.2 | (Not Examined) | (Not examined) |

| Classification | Sintered Magnet: Residual Flux Density (kG) | Sintered Magnet: Energy Product (MGOe) | Sintered Magnet: Coercive Force (kOe) | Sintered Magnet: Evaluation | Area: Average Thickness of Alloy Flakes (mm) | Area: Percentage of Chill Grains (%) | Area: Area Percentage of α-Fe (%) |
|---|---|---|---|---|---|---|---|
| Inventive Ex. 1-A | 18.1 | 50.1 | 14.1 | ○ | 0.30 | 0 | 0 |
| Inventive Ex. 1-B | 18.1 | 50.1 | 14.2 | ○ | 0.11 | 0 | 0 |
| Inventive Ex. 1-C | 18.5 | 50.3 | 14.0 | ○ | 0.50 | 0 | 0 |
| Inventive Ex. 1-D | 18.4 | 50.2 | 14.1 | ○ | 0.90 | 0 | 0 |
| Inventive Ex. 2-A | 18.0 | 50.2 | 14.2 | ○ | 0.30 | 0 | 0 |
| Inventive Ex. 2-B | 18.0 | 50.2 | 14.2 | ○ | 0.11 | 0 | 0 |
| Inventive Ex. 2-C | 18.4 | 50.1 | 14.1 | ○ | 0.50 | 0 | 0 |
| Inventive Ex. 2-D | 18.1 | 50.3 | 14.1 | ○ | 0.90 | 0 | 0 |
| Conventional Ex. | 14.3 | 35.1 | 11.6 | x | 30 | 0 | 0 |
| Comparative Ex. 1 | 16.5 | 48.3 | 13.9 | x | 0.3 | 0 | 0 |
| Comparative Ex. 2 | — | — | — | — | — | — | — |
| Comparative Ex. 3 | 17.9 | 47.5 | 12.2 | x | 0.3 | 0 | 0 |
| Comparative Ex. 4 | 16.1 | 42.3 | 12.4 | x | 0.08 | 5.6 | 0 |
| Comparative Ex. 5 | 15.8 | 41.1 | 12.1 | x | 0.09 | 5.7 | 0 |
| Comparative Ex. 6 | 16.2 | 42.5 | 12.2 | x | 1.1 | 0 | 2.3 |
| Comparative Ex. 7 | 16.1 | 42.1 | 12.1 | x | 1.2 | 0 | 2.5 |

Figure 2:
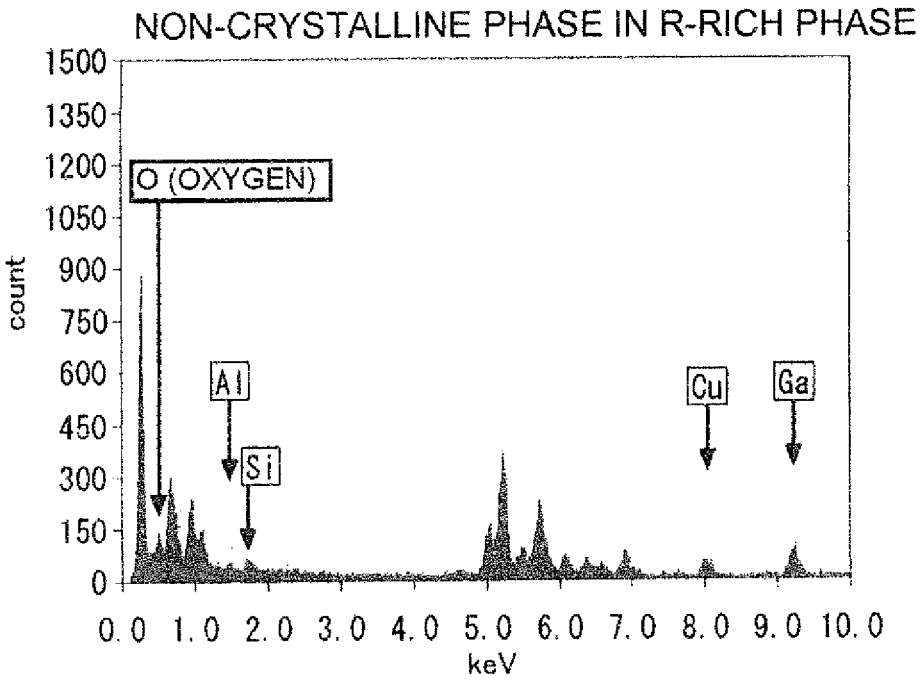
FIGS. 2(*a*) to 2(*c*) show graphs illustrating the results of X-ray analyses of the phases of the alloy flakes of Inventive Example 1-A.
Figure 2:
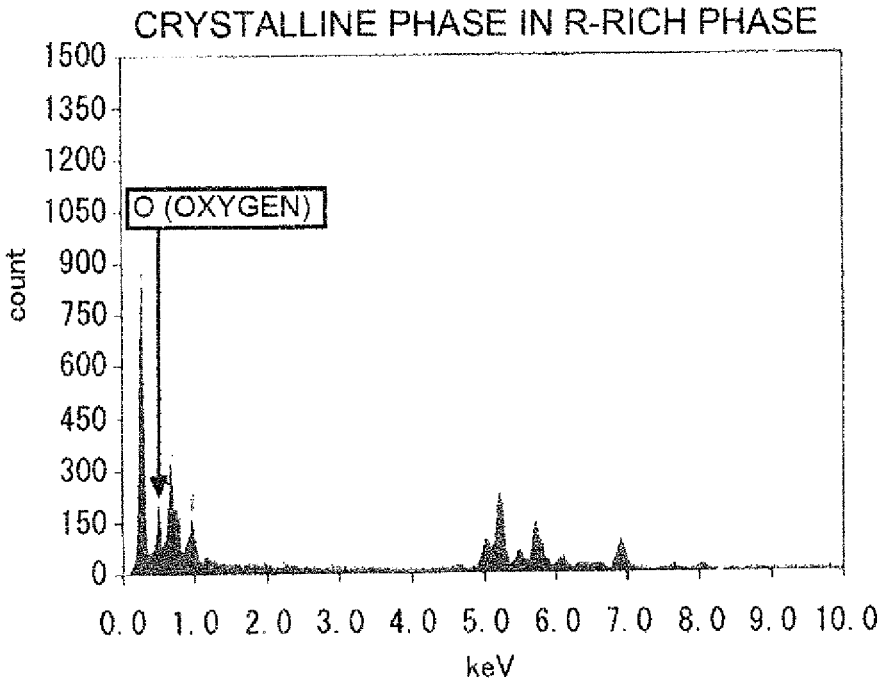
Figure 2:
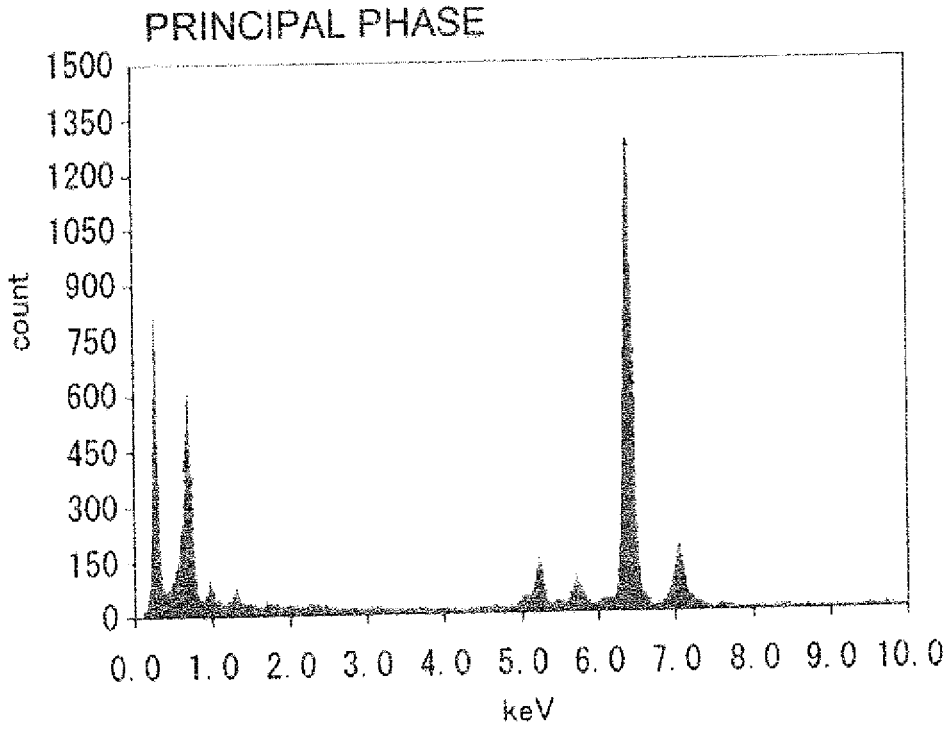

FIG. 1 is an image taken with a transmission electron microscope of the crystal structure of a specimen prepared from the alloy flakes of Inventive Example 1-A. In Inventive Example 1-A, the alloy flakes were produced by crushing a ribbon cast by a strip casting method, and the alloy flakes were thermally maintained at a temperature of 660° C. and thereafter cooled at a cooling rate of 5.0° C. per second. As shown in FIG. 1, in the crystal structure of the alloy flakes of Inventive Example 1-A, an R-rich phase (1 and 2) was formed at the grain boundaries of a principal phase 3, and the R-rich phase had a non-crystalline phase 1 and a crystalline phase 2. FIG. 2 shows the results of energy dispersive X-ray spectroscopy analyses of the observed phases.

FIG. 2 shows graphs illustrating the results of X-ray analyses of the phases of the alloy flakes of Inventive Example 1-A. FIG. 2(*a*) shows the result of analysis of the non-crystalline phase in the R-rich phase; FIG. 2(*b*) shows the result of analysis of the crystalline phase in the R-rich phase; and FIG. 2(*c*) shows the result of analysis of the principal phase. In the analysis of the non-crystalline phase in the R-rich phase, peaks were observed at positions of O (oxygen), Al, Si, Cu, and Ga as shown in FIG. 2(*a*). In the analysis of the crystalline phase in the R-rich phase, a peak was only observed at the position of O (oxygen) while no peaks were observed at positions of Al, Si, Cu and Ga as shown in FIG. 2(*b*). In the analysis of the principal phase, no peaks were observed at any of the positions of O (oxygen), Al, Si, Cu, and Ga as shown in FIG. 2(*c*).

These results demonstrate that: in the crystal structure of the alloy flakes of Inventive Example 1-A, the non-crystalline phase in the R-rich phase has high contents of O (oxygen), Al, Si, Cu and Ga; the crystalline phase in the R-rich phase has a high content of O (oxygen) while having low contents of Al, Si, Cu and Ga; and the principal phase has low contents of O (oxygen), Al, Si, Cu and Ga.

Regarding the Ga content in the R-rich phase of the alloy flakes of Inventive Example 1-A, it was found that the non-crystalline phase has a higher Ga content than that of the crystalline phase because the Ga content percentage of the non-crystalline phase is higher than that of the crystalline phase. The sintered magnet of Inventive Example 1-A was evaluated as having magnetic properties as represented by the symbol ○ and this confirmed that it has good magnetic properties.

In Inventive Example 2-A, the alloy flakes were thermally maintained at a temperature of 880° C. and thereafter cooled at a cooling rate of 4.8° C. per second. The crystal structure of a specimen prepared from the alloy flakes of Inventive Example 2-A was observed using a transmission electron microscope, and it was found that an R-rich phase was formed at the grain boundaries of a principal phase, and the R-rich phase had a non-crystalline phase and a crystalline phase as is the case with Inventive Example 1-A.

X-ray analyses were performed on the phases of the alloy flakes of Inventive Example 2-A, and it was found that: as is the case with Inventive Example 1-A, the non-crystalline phase in the R-rich phase has high contents of O (oxygen), Al, Si, Cu and Ga; the crystalline phase in the R-rich phase has a high content of O (oxygen) while having low contents of Al, Si, Cu and Ga; and the principal phase has low contents of O (oxygen), Al, Si, Cu and Ga. The sintered magnet of Inventive Example 2-A was evaluated as having magnetic properties as represented by the symbol ○ and this confirmed that it has good magnetic properties.

In Conventional Example, the alloy flakes were produced by crushing an ingot cast by a mold casting method. The crystal structure of a specimen prepared from the alloy flakes of Conventional Example was observed using a transmission electron microscope, and it was found that a principal phase and an R-rich phase were present, but there was no non-crystalline phase in the R-rich phase. X-ray analyses were performed on the phases of the alloy flakes of Conventional Example, and peaks were observed at positions of O (oxygen), Al, Si, Cu, and Ga for both the principal phase and the R-rich phase. The sintered magnet of Conventional Example was evaluated as having magnetic properties as represented by the symbol x, which indicates decreased magnetic properties.

In Comparative Example 1, the alloy flakes were produced by crushing a ribbon cast by a strip casting method, and the alloy flakes were thermally maintained at a temperature of 630° C. and thereafter cooled at a cooling rate of 5.3° C. per second. The crystal structure of a specimen prepared from the alloy flakes of Comparative Example 1 was observed using a transmission electron microscope, and it was found that an R-rich phase was formed at the grain boundaries of a principal phase, and the R-rich phase had a non-crystalline phase and a crystalline phase as is the case with Inventive Example 1.

X-ray analyses were performed on the phases of the alloy flakes of Comparative Example 1, and, unlike the case with Inventive Example 1, peaks were observed at positions of O (oxygen), Al, Si, Cu, and Ga for all the phases, i.e., the non-crystalline phase and the crystalline phase in the R-rich phase, and the principal phase. Furthermore, Table 1 shows that the Ga content percentage of the non-crystalline phase is lower than that of the crystalline phase, and therefore it is seen that, in the R-rich phase, the non-crystalline phase has a lower Ga content than that of the crystalline phase. The sintered magnet of Comparative Example 1 was evaluated as having magnetic properties as represented by the symbol x, which indicates decreased magnetic properties.

In Comparative Example 3, the alloy flakes were thermally maintained at a temperature of 660° C. and thereafter cooled at a cooling rate of 0.8° C. per second. The crystal structure of a specimen prepared from the alloy flakes of Comparative Example 3 was observed using a transmission electron microscope, and it was found that an R-rich phase was present at the grain boundaries of a principal phase, but there was no non-crystalline phase in the R-rich phase.

X-ray analyses were performed on the phases of the alloy flakes of Comparative Example 3, and it was found that the crystalline phase in the R-rich phase has high contents of O (oxygen), Al, Si, Cu and Ga and that the principal phase has low contents of O (oxygen), Al, Si, Cu and Ga. The Ga content of the crystalline phase in the R-rich phase was calculated, and it was found that there was a segregation of Ga in the crystalline phase in the R-rich phase. Also, the sintered magnet of Comparative Example 3 was evaluated as having magnetic properties as represented by the symbol x, which indicates decreased magnetic properties.

These results demonstrate that: by forming an R-T-B—Ga-based alloy such that it has a crystal structure in which its R-rich phase includes a non-crystalline phase and a crystalline phase and that the non-crystalline phase in the R-rich phase has a higher Ga content than that of the crystalline phase in the R-rich phase, it is possible to provide sintered magnets manufactured from such alloy with enhanced magnetic properties. Also, it has been found that such magnet material alloys can be fabricated by thermally maintaining alloy flakes and thereafter cooling them in such a manner that the temperature for the thermal maintenance is in the range of 650° C. to the melting temperature of the alloy and the cooling rate is 1° C. to 9° C. per second.

In Inventive Examples 1-A to 1-D and Inventive Examples 2-A to 2-D, the alloy flakes were thermally maintained and thereafter cooled in such a manner that the temperature for the thermal maintenance is in the range of 650° C. to the melting temperature of the alloy and the cooling rate is 1° C. to 9° C. per second, and further, the alloy flakes were formed to have an average thickness of 0.1 mm to 1.0 mm. This allowed the R-T-B—Ga-based alloy to have a crystal structure in which its R-rich phase includes a non-crystalline phase and a crystalline phase, and the non-crystalline phase in the R-rich phase has a higher Ga content than that of the crystalline phase in the R-rich phase. In addition, in the crystal structure of the R-T-B—Ga-based alloy, the area percentage of chill grains was 0% and the area percentage of α-Fe was 0%. That is, there was no formation of chill grains or crystallization of an α-Fe phase in the crystal structure of the R-T-B—Ga-based alloy. Consequently, the sintered magnet was evaluated as having magnetic properties all represented by the symbol ○, which indicates good magnetic properties.

In contrast, in Comparative Examples 4 and 5, in which the alloy flakes were formed to have an average thickness of less than 0.1 mm, formation of chill grains occurred with their area percentages being 5.6% and 5.7%, respectively, in the crystal structure of the R-T-B—Ga-based alloy. Consequently, the magnetic properties were evaluated as ×, which indicates decreased magnetic properties.

In Comparative Examples 6 and 7, in which the alloy flakes were formed to have an average thickness of greater than 1.0 mm, crystallization of an α-Fe phase occurred with their area percentages being 2.3% and 2.5%, respectively, in the crystal structure of the R-T-B—Ga-based alloy. Consequently, the magnetic properties were evaluated as ×, which indicates decreased magnetic properties.

These results confirmed that, when a ribbon is cast by a strip casting method, the average thickness of the alloy flakes is preferably set to be in the range of 0.1 mm to 1.0 mm.

Although the above embodiment was described with reference to the case, as an example, in which the R-T-B—Ga-based alloy is used to manufacture a sintered magnet, the present invention is not limited to this. Likewise, when the alloy is used to manufacture bonded magnets, too, it is possible to improve the magnetic properties of resulting bonded magnets.

INDUSTRIAL APPLICABILITY

The magnet material alloy of the present invention has an R-rich phase that includes a non-crystalline phase having a higher Ga-content. Because of this, when it is used as a material for sintered magnets, it is possible to reduce the reverse magnetic domain nucleation in resulting sintered magnets and thus provide improvement and stabilization of the coercive force thereof. Furthermore, it is possible to improve the saturation magnetization and increase the residual flux density of the resulting sintered magnet.

The method of producing a magnet material alloy of the present invention includes thermally maintaining alloy flakes and thereafter cooling the alloy flakes, wherein the temperature for the thermal maintenance is in the range of 650° C. to the melting temperature of the alloy, and the cooling rate is 1° C. to 9° C. per second. This enables the production of a magnet material alloy having a higher Ga-content non-crystalline phase in its R-rich phase.

As described in the foregoing, the magnet material alloy and the method of producing the same of the present invention, when used to manufacture sintered magnets, greatly contribute to improvement in magnetic properties and quality of the resulting sintered magnets. Thus, they can be effectively utilized in the field of rare earth magnets.

REFERENCE SIGNS LIST

1: non-crystalline phase in R-rich phase,
2: crystalline phase in R-rich phase,
3: principal phase

What is claimed is:

1. An R-T-B—Ga-based magnet material alloy, where R is at least one element selected from rare earth metals including Y and excluding Gd, Tb, Dy, Ho, Er, Tm, Yb, and Lu, and T is one or more transition metals with Fe being an essential element, the R-T-B—Ga-based magnet material alloy, comprising:

an $R_2T_{14}B$ phase which Is a principal phase; and an R-rich phase which is a phase enriched with the R, the R-rich phase Including a non-crystalline phase and a crystalline phase, the non-crystalline phase having a Ga content in mass % that is higher than a Ga content In mass % of the crystalline phase.

2. The R-T-B—Ga-based magnet material alloy according to claim 1, wherein the R-T-B—Ga-based magnet material alloy has an average thickness in a range of 0.1 mm to 1.0 mm.

3. A method of producing the R-T-B—Ga-based magnet material alloy according to claim 1, the method comprising:

a first step of casting a ribbon from a molten R-T-B—Ga-based alloy using a strip casting method and crushing the ribbon to produce alloy flakes;

and a second step of thermally maintaining the alloy flakes by holding the alloy flakes at a predetermined temperature for a predetermined time and then cooling the alloy flakes;

the first step and the second step being performed under reduced pressure or in an inert gas atmosphere;

the second step being performed such that the alloy flakes are thermally maintained at a temperature in a range of 650° C. to the melting temperature of the alloy, and after the thermal maintenance, the alloy flakes are cooled at a cooling rate of 1° C. to 9° C. per second to at least 400° C.

4. A method of producing the R-T-B—Ga-based magnet material alloy according to claim 2, the method comprising:

a first step of casting a ribbon from a molten R-T-B—Ga-based alloy using a strip casting method and crushing the ribbon to produce alloy flakes;

and a second step of thermally maintaining the alloy flakes by holding the alloy flakes at a predetermined temperature for a predetermined time and then cooling the alloy flakes;

the first step and the second step being performed under reduced pressure or in an inert gas atmosphere;

the second step being performed such that the alloy flakes are thermally maintained at a temperature in a range of 650° C. to the melting temperature of the alloy, and after the thermal maintenance, the alloy flakes are cooled at a cooling rate of 1° C. to 9° C. per second to at least 400° C.

* * * * *